US006501056B1

(12) United States Patent
Hirohata et al.

(10) Patent No.: US 6,501,056 B1
(45) Date of Patent: Dec. 31, 2002

(54) CARBON HEATING ELEMENT AND METHOD OF MANUFACTURING THE SAME

(75) Inventors: Takeshi Hirohata, Kawachinagano (JP); Sadataka Tamura, Toyonaka (JP); Yuzuru Takahashi, Toyonaka (JP)

(73) Assignees: E. Tec Corporation, Shiga (JP); Osaka Prefectural Government, Osaka (JP)

( * ) Notice: Subject to any disclaimer, the term of this patent is extended or adjusted under 35 U.S.C. 154(b) by 0 days.

(21) Appl. No.: 09/674,467

(22) PCT Filed: Apr. 27, 1999

(86) PCT No.: PCT/JP99/02251

§ 371 (c)(1),
(2), (4) Date: Oct. 27, 2000

(87) PCT Pub. No.: WO99/56502

PCT Pub. Date: Nov. 4, 1999

(30) Foreign Application Priority Data

Apr. 28, 1998 (JP) ..... 10-134324

(51) Int. Cl.[7] ..... H05B 3/10
(52) U.S. Cl. ..... 219/553
(58) Field of Search ..... 219/552, 553, 219/464.1, 541, 542, 460.1, 463.1; 313/315, 331, 332, 283, 284, 285, 289

(56) References Cited

U.S. PATENT DOCUMENTS 4,626,964 A * 12/1986 Azuma et al. ..... 361/502
4,960,979 A 10/1990 Nishimura
5,238,619 A * 8/1993 McGuigan et al. ..... 264/42
6,043,468 A 3/2000 Toya et al.
6,057,532 A * 5/2000 Dexter et al. ..... 219/553

FOREIGN PATENT DOCUMENTS

| | | |
|---|---|---|
| JP | 49-13958 | 4/1974 |
| JP | 1-227377 | 9/1989 |
| JP | 5-135858 | 6/1993 |
| JP | 7-296955 | 11/1995 |
| JP | 9-45467 | 2/1997 |
| JP | 10-55877 | 2/1998 |
| JP | 11-214125 | 8/1999 |
| JP | 11-42988 | 9/1999 |
| JP | 11-242984 | 9/1999 |
| JP | 11-242985 | 9/1999 |
| JP | 11-242986 | 9/1999 |
| JP | 11-242987 | 9/1999 |
| JP | 11-354257 | 12/1999 |
| JP | 2000-48938 | 2/2000 |
| JP | 2000-82574 | 3/2000 |
| JP | 2000-113963 | 4/2000 |
| JP | 2000-223245 | 8/2000 |

* cited by examiner

*Primary Examiner*—Sang Paik
(74) *Attorney, Agent, or Firm*—Knobbe, Martens, Olson & Bear LLP

(57) ABSTRACT

A carbon heating element of excellent durability and thermal shock resistance, usable even in a special environment, for example, even in a strong oxidizing chemical, and having a sufficient capability of generating heat with smaller power consumption. The carbon heating element is formed by covering a carbon material, such as carbon fiber or a carbon fiber cloth with quarts glass, making the interior of the quartz glass vacuous or setting the pressure of the interior of the quartz to not higher than 0.2 atm. with substituted inert gas, and melt-scal the quartz glass.

11 Claims, 1 Drawing Sheet

CARBON HEATING ELEMENT AND METHOD OF MANUFACTURING THE SAME

This application is the U.S. National Phase under 35 U.S.C. §371 of International Application PCT/JP99/02251, filed Apr. 27, 1999, which claims priority based on JP 10-134324, filed Apr. 28, 1998.

TECHNICAL FIELD

The present invention relates to a carbon heating element having excellent durability even when repeatedly used in a high-temperature environment, and a method of manufacturing the same.

BACKGROUND ART

Nichrome and carbon materials are generally used as heating elements.

Nichrome wires are not usable in an atmosphere of a halogen gas, an acid gas, a corrosive gas or the like. In such a special environment, carbon materials are utilized because of their chemical stability. Carbon materials, however, are not usable in an environment in which a strong oxidizing chemical, such as concentrated nitric acid or fuming concentrated nitric acid, is generated.

Further, carbon materials can be used in a high-temperature environment only if the atmosphere is non-oxidizing, and are not usable in air at a temperature higher than about 400° C., since air oxidizes carbon materials.

Known carbon heating elements usable in air at a high temperature of 400° C. or more include carbon heating elements comprising a ceramic or glass covering material on the surface of a carbon material to thereby protect the carbon material from oxygen. In such carbon heating elements, the covering material is in complete contact with the surface of the carbon material, so as to block oxygen and protect the inside carbon material from oxidation.

However, the covering material and the carbon material are different from each other in expansion coefficient, so that the covering material will peel off and lose its covering effect when repeatedly used. Further, these heating elements are limited in application because the covering material has low thermal shock resistance.

TECHNICAL OBJECT

The present invention solves or remarkably reduces the problems of the prior art. The main object of the present invention is to provide a carbon heating element having excellent durability to withstand repeated use even when heated in air at about 1000° C.

Another object of the present invention is to provide a carbon heating element having excellent thermal shock resistance to withstand rapid temperature change.

A further object of the present invention is to provide a carbon heating element usable in a special environment such as in a strong oxidizing chemical.

A still further object of the present invention is to provide a carbon heating element having a capacity to generate sufficient heat with lower power consumption.

DISCLOSURE OF THE INVENTION

Figure 1:
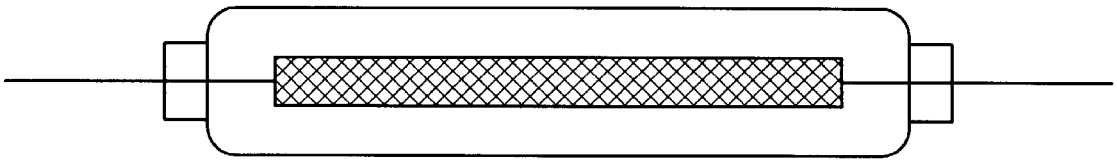
FIG. 1 illustrates one aspect of a carbon heating element of the present invention.

The present inventors carried out intensive research in view of the above problems and found that, only when using quartz glass as a cover for a carbon material, a carbon heating element can be obtained which has a long-term preventive effect against oxidization and excellent thermal shock resistance to withstand thermal shock such as rapid heating or cooling, and is usable in a strong oxidizing chemical.

The present inventors also found that a carbon heating element with a higher capacity to generate heat can be obtained when using a low density carbon material. The present invention has been accomplished based on the above findings.

The present invention provides the following carbon heating elements and methods of manufacturing the elements:

1. A carbon heating element comprising a carbon material and a quartz glass cover.
2. The carbon heating element according to Item 1, wherein the carbon material is at least one member selected from the group consisting of carbon fiber, carbon fiber cloth, a wood carbon material, a carbon rod and a shaped article of carbon powder.
3. The carbon heating element according to Item 1, wherein the carbon material is carbon fiber.
4. The carbon heating element according to Item 1, wherein the carbon material is carbon fiber cloth.
5. The carbon heating element according to Item 1, wherein air inside the quartz glass cover has been displaced with an inert gas to set a pressure inside the cover at 0.2 atmospheres or less.
6. A method of manufacturing a carbon heating element, comprising placing a quartz glass cover around a carbon material, and melt-sealing the cover in such a manner that air inside the cover is evacuated or displaced with an inert gas to set a pressure inside the cover at 0.2 atmospheres or less.

The carbon heating element of the present invention comprises a carbon material and a quartz glass cover.

The quarts glass for use in the invention is not limited, and may be, for example, quartz glass prepared by melting crystals; quartz glass prepared using high-purity $SiCl_4$, $SiH_4$ or the like as a starting material; quartz glass prepared by melting silica sand; or quartz glass prepared using silica glass as a starting material. When employing quartz glass prepared using silica glass as a starting material, the quartz glass cover can be prepared by, for example, a process comprising shaping silica glass at about 550 to 620° C., splitting the silica glass into a $B_2O_3$—$Na_2O$ phase and a $SiO_2$ phase, treating the glass with hydrochloric acid or like acid, and carrying out heat treatment at about 1000 to 1200° C. Silica glass is easy to shape because it has a lower softening temperature than quartz glass. It is preferable to use silica glass with a high purity of, for example, about 95% or more, preferably 98% or more.

The thermal shock strength ($\Delta T$) of the quartz glass cover for use in the invention is not limited, and is usually about 950° C. or more, preferably about 980° C. or more. The coefficient of linear expansion of the quartz glass cover for use in the invention is not limited, and is preferably about $10^{-6}$ or less.

The quartz glass for use in the invention is not limited to colorless, transparent one, but may be opaque quartz glass containing air bubbles, ground quartz glass having slightly rough surfaces, colored (e.g., black-colored) quartz glass, or the like. Colored quartz glass, in particular black-colored quartz glass, is preferred because a carbon heating element comprising such glass will have a higher emissivity and is capable of emitting an increased amount of far infrared radiation.

Colored quartz glass can be prepared by conventional processes, for example, by applying and baking a glaze on quartz glass, or by dissolving manganese salt in quartz glass.

The quartz glass cover according to the invention is not limited in thickness as long as the contemplated effects can be achieved, but has a mean thickness of usually about 0.04 to 3 mm, preferably about 0.1 to 2 mm. A quartz glass cover with too small a thickness will be insufficient in mechanical strength, and will be likely to break due to, for example, a small crack or thermal stress caused by prolonged heating.

The carbon material for use in the present invention is not limited and may be, for example, carbon fiber, carbon fiber cloth, a wood carbon material, a carbon rod or a shaped article of carbon powder. These carbon materials may be used either singly or in combination. A low density carbon material is preferred for use in the invention, since it is capable of emitting a greater amount of far infrared radiation and has a higher capacity to generate heat, due to its large apparent volume. The density of the carbon material is not limited, but is usually about 1.5 g/cm$^3$ or less, preferably about 0.01 to 0.6 g/cm$^3$, more preferably about 0.05 to 0.25 g/cm$^3$.

The carbon material for use in the invention is not limited in molecular structure, and may be, for example, graphite carbon, amorphous carbon or carbon having an intermediate crystalline structure between graphite carbon and amorphous carbon.

The carbon fiber for use in the present invention is not limited in kind, and may be, for example, natural fiber-based carbon fiber prepared using natural fiber such as cotton as a starting material; PAN (polyacrylonitrile)-based carbon fiber; cellulose-based carbon fiber; glassy carbon fiber such as phenolic resin-based carbon fiber, furan-based carbon fiber or polycarbodiimide-based carbon fiber; pitch-based carbon fiber such as anisotropic pitch-based carbon fiber, isotropic pitch-based carbon fiber or synthetic pitch-based carbon fiber; polyvinyl alcohol-based carbon fiber; activated carbon fiber; or coiled carbon fiber.

The fiber diameter of the carbon fiber for use in the invention is not limited as long as the contemplated result can be achieved, and may be usually about 5 to 20 $\mu$m, preferably about 7 to 15 $\mu$m, more preferably about 7 to 11 $\mu$m.

The carbon fiber for use in the invention may be in the form of tow or twisted yarn. The diameter of the tow or twisted yarn is not limited as long as the contemplated result can be achieved, and is usually about 0.05 to 10 mm, preferably about 0.1 to 5 mm. The tow or twisted yarn of the carbon fiber may be further twisted together, where necessary.

The carbon fiber may be used in the form of carbon fiber cloth. The carbon fiber cloth is not limited in kind, and may be, for example, fabric obtained by weaving the carbon fiber, non-woven fabric, or felt.

The density of the carbon fiber cloth for use in the invention is not limited, but is preferably low, more preferably about 0.01 to 0.5 g/cm$^3$, particularly about 0.05 to 0.25 g/cm$^3$. The porosity of the carbon fiber cloth is not limited, but is preferably high, more preferably about 80% or more, particularly about 90 to 97%.

The size ratio of the carbon material to the quartz glass cover is not limited. For example, when the carbon material has the form of wire, rod, strip or the like and the quartz glass cover has the form of tube, the quartz glass tube may have an inside diameter about 0.1 to 200% greater than the largest dimension of the carbon material.

In the carbon heating element of the invention, the quartz glass cover may be in or out of contact with the carbon material. The interior of the quartz glass cover may be vacuous or filled with a noble gas such as argon gas, neon gas or xenon gas, or an inert gas such as nitrogen gas. When the interior of the cover is filled with an inert gas, it is preferred that the inert gas has a reduced pressure, since the gas expands when heated. The pressure of the inert gas is preferably about 0.2 atmospheres or less, more preferably about $1\times10^{-3}$ atmospheres or less, at ambient temperature (25° C.).

The carbon heating element of the present invention may have at least two electrodes for electric contact, for example at the end portions of the carbon material. The material of the electrodes is not limited and may be any of conventional electrode materials. Examples of electrode materials include copper, silver, molybdenum, tungsten and like metals. The shape of the electrodes can be selected according to the intended use of the heating element.

The carbon heating element of the invention can be produced by, for example, placing a quartz glass cover around a carbon material, and melt-sealing the cover in such a manner as to make the interior of the cover vacuous or displace air inside the cover with an inert gas to set a pressure inside the cover at 0.2 atmospheres or less.

The carbon heating element of the invention may be in any shape according to the intended use, or the shape of the carbon material or the quartz glass cover. The carbon heating element may have the shape of, for example, rod, plate, pipe or the like. The rod-shaped carbon heating element may be made into a desired shape such as U shape or W shape by softening the quartz glass by heat treatment. The heat treatment may be performed either before or after sealing the carbon material in the quartz glass cover. The heat treatment is carried out at a temperature sufficient to soften the quartz glass, preferably 1500 to 1700° C.

The electrodes can be formed on the carbon heating element by conventional methods, for example, a method comprising covering the end portions or other portions of the carbon material with metal foil or the like and crimping the covered portions to obtain electrodes, or a method comprising winding metal wire around the end portions or other portions of the carbon material.

The electrodes may be formed either before or after the step of melt-sealing the carbon material in the quartz glass cover. When a carbon material on which electrodes have been made is sealed in the quartz glass cover, the quartz glass cover can be melt-sealed so that the electrodes protrude out of the cover. When the electrodes are formed after sealing the carbon material in the quartz glass cover, the quartz glass cover can be melt-sealed so that the end portions of the carbon material protrude out of the cover, and then the electrodes can be formed on the end portions of the carbon material.

The method of manufacturing the carbon heating element of the present invention will be described below in further detail.

The carbon material is placed in a quartz glass tube, and one end of the quartz glass tube is melt-sealed. An acetylene burner, an oxyhydrogen flame burner or like high-temperature burner can be used for melt-sealing. When using a carbon material on which electrodes have been formed in advance, the melt-sealing can be carried out while cooling the electrode portion to be melt-sealed using a cooling water pipe or the like. The tube is then deaerated from the other end to produce a vacuum inside the quartz glass tube, and the other end is melt-sealed by the method described above so that the carbon material is not exposed to outer air.

Alternatively, the following method can be employed: A carbon material is placed in a T-shaped quartz glass tube, and two ends of the tube are melt-sealed. The other end of the T-shaped tube is connected to a vacuum pump and an inert gas cylinder to make the interior of the quartz glass tube vacuous or displace air in the quartz glass tube with an inert gas, to completely remove air from the tube. Then, the quartz glass tube is melt-sealed.

Where necessary, the quartz glass tube may be brought into contact with the carbon material by, for example, the following method: The quartz glass tube is melt-sealed at both ends while reducing the pressure in the tube or making the interior of the tube vacuous, and heat-treated at a high temperature. Since the pressure in the quartz glass tube has been reduced, the tube melts and comes into close contact with the carbon material when softened by the high temperature heat treatment. The heat treatment can be carried out at a temperature sufficient to soften the quartz glass tube, usually about 1500 to 1700° C.

Alternatively, air in the quartz glass tube may be displaced with an inert gas. In this case, for example, a method can be employed which comprises melt-sealing one end of the tube and introducing an inert gas from the other end to displace the air in the tube.

When the carbon material has a plate shape, the carbon heating element can be obtained by a method comprising sandwiching the carbon material between two quartz glass plates, and heat-treating the sandwich structure at a high temperature and pressurizing the sandwich structure from the upper and lower surfaces to hermetically seal the carbon material. The high-temperature heat treatment is carried out at a temperature sufficient to soften the quartz glass, usually at about 1500° C. to 2000° C., preferably at about 1600 to 1750° C. The period of time to maintain the specified temperature can be determined according to the size of the carbon heating element and other factors, and is usually about 2 to 10 minutes. The pressure to be applied to the quartz glass plates is not limited and may be usually a pressure close to the contact pressure.

Alternatively, the carbon heating element can be produced by a method comprising embedding a carbon material in a quartz glass powder, heating the quartz glass powder in a non-oxidizing atmosphere to melt the quartz glass, and applying a pressure. The temperature for melting the quartz glass is usually about 1650 to 1800° C. The period of time to maintain the specified temperature can be determined according to the size of the carbon heating element and other factors, but is usually about 30 minutes to 1 hour. The pressure applied after melting the quartz glass is not limited, and is usually about 98 kPa or less.

The carbon heating element of the invention is used by connecting the electrodes to an external power source for energization. The carbon heating element can be used as a heating element for heaters such as room heaters and floor heaters, a heating element for cooking equipment, a heating element for equipment for melting snow or preventing fogging, or a heating element for office automation equipment, or the like. Further, the carbon heating element can be used in a poor environment such as in a waste disposal plant.

EFFECTS OF THE INVENTION

The carbon heating element of the present invention is amenable to repeated use in air in a high temperature range, which has not been achieved by conventional carbon heating elements. The carbon heating element of the invention does not corrode and shows excellent durability even in a strongly oxidizing environment.

Further, the carbon heating element of the invention has excellent thermal shock resistance which cannot be realized by conventional carbon heating elements which comprise ceramic or glass as a covering material.

The carbon heating element of the invention has a high capacity to generate heat. In particular, when using a low density carbon material as the carbon material, the resulting carbon heating element shows a higher capacity to generate heat. For example, when carbon fiber cloth is used as the carbon material, it is preferable to select carbon fiber cloth having a higher porosity and thus having an increased apparent volume, so that a carbon heating element can be obtained which is capable of maintaining the same surface temperature with lower power consumption and emitting an increased amount of far infrared radiation.

BEST MODE FOR CARRYING OUT THE INVENTION

The following Examples are provided to illustrate the features of the present invention in further detail, and not to limit the scope of the invention.

EXAMPLE 1

A 22 cm length of glassy carbon fiber in the form of twisted yarn having a diameter of about 2 mm (CFY0204-3, a product of NIPPON KYNOL INC., number of twists: 60T/m) was placed in a transparent quartz glass tube with an outside diameter of 5 mm and an inside diameter of 3 mm. One end of the carbon fiber was passed through a copper tube with an outside diameter of 3 mm, an inside diameter of 2 mm and a length of 2 cm, and the copper tube was crimped to form an electrode. The same copper tube as above was wound around the electrode portion three times, and water was flowed through the copper tube to cool the electrode portion.

Subsequently, the end of the quartz glass tube was melt-sealed using an oxyhydrogen flame burner. The other end of the tube was connected to one end of a thick rubber tube, and the other end of the rubber tube was fitted with a glass three-way cock. The other two openings of the three-way cock were respectively connected to a vacuum pump and an argon gas cylinder. A cycle consisting of deaeration and feeding of argon gas was carried out twice, and a vacuum was produced in the glass tube. Then, the quartz glass tube was melt-sealed at a portion about 1.5 cm inside from the end of the carbon fiber. The part of the glass tube outside the sealed portion was cut off. Then, the carbon fiber was pulled out, and a copper tube was covered and crimped in the above manner to form the other electrode portion. While cooling the electrode portion, the quartz glass tube was melt-sealed so that the part of the carbon fiber between the electrode portion and melt-sealed portion did not contact with air.

The part of the glass tube between the electrodes was heated until softening, to make the quartz glass melt and closely contact with the carbon fiber. Then, it was confirmed that the carbon fiber was out of contact with air. In this manner, several carbon heating elements each having a quartz glass cover were produced.

The temperature of each heating element was controlled with a temperature controller for precise electric furnaces (FK-1000-FP90, a product of FULL-TECH), using an infrared thermocouple (IRt/c. 10/38AULF, measurable temperature range: −18 to 1370° C., response time: 200 msec) as a thermocouple for temperature measurement. These devices were connected to each carbon heating element, and used after determining the device constant in air.

For testing the durability of the carbon heating elements, the surface temperatures of three of the carbon heating elements were set at 800° C., 1000° C. and 1250° C., respectively, in air. After maintaining the respctive temperatures for 300 hours, the change of the surface condition was visually inspected.

The thermal shock resistance of the carbon heating elements were tested by heating the surface of one of the heating elements to 1000° C. and throwing the element into water at about 15° C.

Further, one of the heating elements was shaped into U shape, placed in a mixture of concentrated sulfuric acid and concentrated nitric acid (1:1) in such a manner that the electrodes were out of contact with the acid mixture, and energized. After being maintained at 100° C. for 100 hours, the heating element was washed with water and dried. Then, the change in the surface condition was visually inspected. The results of these tests are shown in Tables 1 and 2.

EXAMPLE 2

Carbon heating elements were produced in the same manner as in Example 1 except that PAN-based carbon fiber in the form of tow (tow diameter: about 2 mm, tow length: 22 cm) were used in place of the glassy carbon fiber.

The durability, thermal shock resistance and durability in strong acid solution of the carbon heating elements were tested by the same methods as in Example 1. The results are shown in Tables 1 and 2.

EXAMPLE 3

Carbon heating elements were produced in the same manner as in Example 1 except that pitch-based carbon fiber in the form of tow (tow diameter: about 2 mm, tow length: 22 mm) was used in place of the glassy carbon fiber.

The durability, thermal shock resistance and durability in strong acid solution of the carbon heating elements were tested by the same methods as in Example 1. The results are shown in Tables 1 and 2.

EXAMPLE 4

Wood pieces were carbonized in a nitrogen atmosphere by raising the temperature of the atmosphere from ambient temperature to 1000° C. over 10 hours, to thereby obtain a wood carbon material. Carbon heating elements were produced in the same manner as in Example 1 except that the obtained wood carbon material (220×1.5×1.5 mm, density: 0.2 g/cm$^3$) was used as the carbon material.

The durability, thermal shock resistance and durability in strong acid solution of the carbon heating elements were tested by the same methods as in Example 1. The results are shown in Tables 1 and 2.

Also, carbon heating elements were produced in the same manner as in Example 1, except for using wood carbon material (220×1.5×1.5 mm, density: 0.53 g/cm$^3$) prepared by carbonizing, in the above manner, wood pieces treated with hydrostatic pressure of 4000 atmospheres for 30 minutes using a cold isostatic press (CIP, a product of Nikkiso K.K.) before carbonizing. The resulting carbon heating elements had durability, thermal shock resistance and durability in strong acid solution, all equivalent to those of the carbon heating elements produced using the wood carbon material without CIP treatment.

EXAMPLE 5

Carbon heating elements were produced in the same manner as in Example 1 except that the pressure in the quartz glass tube was set at 0.2 atmospheres by displacing air in the tube with argon gas.

The durability, thermal shock resistance and durability in strong acid solution of the carbon heating elements were tested by the same methods as in Example 1. The results are shown in Tables 1 and 2.

EXAMPLE 6

Each end portions of pitch-based carbon fiber in the form of tow (tow diameter: about 2 mm, apparent resistance at ambient temperature: 50Ω) was wound with 0.3 mm molybdenum wire ten times, and the pitch-based carbon fiber was placed in a T-shaped quartz glass tube having an inside diameter of 1 cm. Two ends of the tube were melt-sealed so that a sufficient length of molybdenum wire protruded from each of the two ends of the tube. The open end of the T-shaped glass tube was connected to a vacuum pump and an argon gas cylinder, and a cycle consisting of deaeration and feeding of argon gas was carried out twice. Then, a vacuum was produced in the tube, and the tube was melt-sealed. In this manner, several contemplated carbon heating elements each having a length of 30 cm were obtained.

Five of the carbon heating elements were energized, and a chromel-almel thermocouple was contacted to the center portion of the outer surface of each heating element. The surface temperatures of the carbon heating elements were set at 200° C., 300° C., 400° C., 500° C. and 600° C., respectively. The carbon heating elements were maintained at respective temperatures to determine the average power consumption per minute during the period from 1 minute to 10 minutes after starting maintenance of the temperatures. The results are shown in Table 3.

EXAMPLE 7

Felt-like carbon fiber cloth (density: 0.063 g/cm$^3$, porosity: 96.2%) was produced using carbon fiber obtained by carbonizing cotton fiber.

Using carbon fiber cloth (270×7×6 mm, apparent resistance at ambient temperature: 50Ω) and quartz glass tubes (outside diameter: 12 mm, inside diameter: 10 mm), carbon heating elements were produced in the same manner as in Example 6. The obtained heating elements were tested by the same methods as in Example 6. The results are shown in Table 3.

EXAMPLE 8

A carbon heating element produced in the same manner as in Example 7 was energized. The energization was stopped when the surface temperature exceeded 40° C., and the amount of far infrared radiation was measured at several temperatures in the self-cooling process.

The measurement was carried out at an environmental temperature of 15±0.2° C., at a humidity of 47±3%, with an emissivity of 0.98. An infrared radiation meter (TGS sensor) and a radiation thermometer were placed at a distance of 30 cm from the sample to measure the amount of infrared radiation (wavelentgh: 7 to 30 $\mu$m) and the surface temperature. The results are shown in Table 4.

EXAMPLE 9

A carbon heating element produced in the same manner as in Example 7 was energized. The energization was stopped when the surface temperature exceeded 150° C., and the amount of far infrared radiation was measured at several temperatures in the self-cooling process.

The measurement was carried out at an environmental temperature of 19 to 20° C., at a humidity of 45.7±2%, with an emissivity of 0.98. The measurement was carried out in the same manner as in Example 8, except for using a PZT sensor as an infrared radiation meter. The results are shown in Table 4.

COMPARATIVE EXAMPLE 1

Several pieces of the same glassy carbon fiber as in Example 1 were used as heating elements without a quartz glass cover.

Using the same devices as in Example 1, the surface temperature of one of the heating element was maintained at 1000° C., and the length of time until the heat element disconnected was measured.

Further, one of the heating elements was placed in a mixture of concentrated sulfuric acid and concentrated nitric acid (1:1), maintained at 100° C. for 100 hours, washed with water and dried. Then, the surface condition was visually inspected. The results are shown in Tables 1 and 2.

COMPARATIVE EXAMPLE 2

Carbon heating elements were produced in the same manner as in Example 1 except that first grade hard glass tubes (outside diameter: 5 mm, inside diameter: 3 mm) were used in place of the quartz glass tubes.

When one of the obtained carbon heating elements was heated, the first grade hard glass tube was softened before the surface temperature reached 1000° C. Moreover, when one of the heating elements was thrown into water at 15° C., it broke into pieces.

COMPARATIVE EXAMPLE 3

A 25 cm length of the same carbon fiber as in Example 1 was impregnated with a resol phenolic resin (synthesized using an ammonium catalyst) diluted with methanol to a resin solid content of 10 wt %. The carbon fiber was then deaerated and dried in air for 24 hours. The resulting carbon fiber was placed in an electric furnace, heated from ambient temperature to 100° C. over 2 hours, and further heated from 100° C. to 150° C. over 5 hours for hardening. Further, the carbon fiber was heated to 250° C. over 1 hour, and maintained at 250° C. for 1 hour. Subsequently, while flowing argon gas, the temperature was raised to 350° C. over 2 hours, then to 500° C. over 5 hours, and then to 1000° C. over 10 hours, and maintained at 1000° C. for 1 hour. Using the obtained carbon-carbon composite (density: 1.55 g/cm$^3$), a carbon heating element was produced in the same manner as in Example 1.

The obtained carbon heating element was energized and maintained at a surface temperature of 1000° C. to measure the length of time until the heating element disconnected. The result is shown in Table 1.

COMPARATIVE EXAMPLE 4

0.3 mm diameter nichrome wire was cut into lengths so that each of the resulting lengths of wire had an apparent resistance of 50Ω. The lengths of wire were shaped into spirals, and each spiral was placed into a quartz glass tube. The subsequent procedure was carried out in the same manner as in Example 1 to produce carbon heating elements.

The average power consumption of each of the obtained heating elements was measured in the same manner as in Example 6. The result is shown in Table 3.

COMPARATIVE EXAMPLE 5

The average power consumption of commercially available halogen heaters (length: 36 cm, diameter: 1 cm) was measured in the same manner as in Example 6. The results are shown in Table 3.

COMPARATIVE EXAMPLE 6

The far infrared radiation amount and surface temperature of silk fabric were measured in the same manner as in Example 8. The results are shown in Table 4.

COMPARATIVE EXAMPLE 7

The far infrared radiation amount and surface temperature of a human palm were measured in the same manner as in Example 8. The results are shown in Table 4.

COMPARATIVE EXAMPLE 8

The far infrared radiation amount and surface temperature of a heating element produced in the same manner as in Comparative Example 4 were measured in the same manner as in Example 9. The results are shown in Table 4.

TABLE 1

| | Surface temperature (° C.) | | |
|---|---|---|---|
| | 800 | 1000 | 1250 |
| Ex. 1 | No change | No change | Devitrified after 24 hours |
| Ex. 2 | No change | No change | Devitrified after 24 hours |
| Ex. 3 | No change | No change | Devitrified after 24 hours |
| Ex. 4 | No change | No change | Devitrified after 24 hours |
| Ex. 5 | No change | No change | Devitrified after 24 hours |
| Comp. Ex. 1 | — | Disconnected after 7 hours | — |
| Comp. Ex. 2 | — | Softened | — |
| Comp. Ex. 3 | — | Disconnected after 20 hours | — |

Note: In Table 1, "devitrified" means that the transparent quartz glass tubes clouded. The heating elements were usable even after devitrification.

TABLE 2

| | Thermal shock resistance | Concentrated sulfuric acid: concentrated nitric acid = 1:1 |
|---|---|---|
| Ex. 1 | No change | No change |
| Ex. 2 | No change | No change |
| Ex. 3 | No change | No change |
| Ex. 4 | No change | No change |
| Ex. 5 | No change | No change |
| Comp. Ex. 1 | — | Corroded on the surface |
| Comp. Ex. 2 | Broke into pieces | — |

Note: In Table 2, "concentrated sulfuric acid: concentrated nitric acid 1:1" indicates the volume ratio. The temperature of the acid mixture was 100° C.

TABLE 3

| | Average power consumption for maintaining the surface temperature | | | | |
|---|---|---|---|---|---|
| | Surface temperature of quartz glass tube (° C.) | | | | |
| | 200 | 300 | 400 | 500 | 600 |
| Ex. 6 (W) | 150 | 256 | 584 | 796 | 956 |
| Ex. 7 (W) | 84 | 114 | 222 | 330 | 486 |
| Comp. Ex. 4 (W) | 178 | 326 | 884 | — | — |
| Comp. Ex. 5 (W) | 165 | 300 | 800 | — | — |

Note: In Comparative Examples 4 and 5, the surface temperatures of the quartz glass tubes did not reach 430° C. at the maximum voltage of 100 V.

The carbon heating elements were capable of maintaining the same temperature with lower power consumption than the heating elements having the same shape as the carbon heating elements but comprising nichrome or other materials. In particular, the carbon heating elements comprising carbon fiber cloth (Example 7) were capable of maintaining the same temperature with 25 to 50% of the power consumption of the heating elements comprising nichrome (Comparative Example 4) or a halogen heater (Comparative Example 5). Further, the carbon heating elements comprising carbon fiber cloth (Example 7) had a resistivity about 50 times higher than the heating elements comprising nichrome (COMPARATIVE EXAMPLE 4).

TABLE 4

| | Far infrared radiation amount at several temperatures (W/m$^2$) | | | | | |
|---|---|---|---|---|---|---|
| | Surface temperature (° C.) | | | | | |
| | 30 | 35 | 40 | 79 | 101 | 128 |
| Ex. 8 | 6.5 | 8.4 | 10.2 | — | — | — |
| Comp. Ex. 6 | 5.4 | 7.0 | 8.8 | — | — | — |
| Comp. Ex. 7 | — | 4.8 | — | — | — | — |
| Ex. 9 | — | — | — | 15 | 37 | 57 |
| Comp. Ex. 8 | — | — | — | 3.2 | 4.1 | 6.8 |

What is claimed is:

1. A carbon heating element comprising amorphous carbon having a density of 0.01 to 0.6 g/cm$^3$ and a quartz glass cover, wherein air inside the quartz glass cover has been evacuated or displaced with an inert gas to set a pressure inside the cover at 0.2 atmospheres or less.

2. The carbon heating element according to claim 1, wherein the amorphous carbon is natural fiber-based carbon fiber or carbon fiber cloth prepared using natural fiber-based carbon fiber.

3. The carbon heating element according to claim 2, wherein the carbon fiber or the carbon fiber cloth is made from cotton.

4. The carbon heating element according to claim 1, wherein the amorphous carbon is made of carbon fibers having a diameter of 5–20 $\mu$m.

5. The carbon heating element according to claim 1, wherein the amorphous carbon is made of a carbon fiber cloth having a density of 0.01–0.5 g/cm$^3$.

6. The carbon heating element according to claim 1, wherein the amorphous carbon is made of a carbon fiber cloth having a porosity of no less than 80%.

7. The carbon heating element according to claim 1, wherein the quartz glass has a thickness of 0.04–3 mm.

8. The carbon heating element according to claim 1, wherein the amorphous carbon is made of a carbon fiber cloth having a porosity of 90 to 97%.

9. The carbon heating element according to claim 1, wherein the amorphous carbon is fabric obtained by weaving the carbon fiber, non-woven fabric, or felt.

10. The carbon heating element according to claim 1, wherein the amorphous carbon is felt-like carbon fiber cloth.

11. A method of manufacturing a carbon heating element, comprising placing a quart glass cover around amorphous carbon having a density of 0.01 to 0.6 g/cm$^3$, and melt-sealing the cover in such a manner that air inside the cover is evacuated or displaced with an inert gas to set a pressure inside the cover at 0.2 atmospheres or less.

* * * * *

UNITED STATES PATENT AND TRADEMARK OFFICE

CERTIFICATE OF CORRECTION

PATENT NO. : 6,501,056 B1 
DATED : December 31, 2002
INVENTOR(S) : Takeshi Hirohata, Sadataka Tamura and Yuzuru Takahashi It is certified that error appears in the above-identified patent and that said Letters Patent is hereby corrected as shown below:

Title page,
Item [56], References Cited, FOREIGN PATENT DOCUMENTS, please change the document number to -- 11-242988, -- not "11-42988."

Signed and Sealed this

Seventeenth Day of June, 2003

JAMES E. ROGAN
*Director of the United States Patent and Trademark Office*